US012637316B2

(12) United States Patent
Mae

(10) Patent No.: US 12,637,316 B2
(45) Date of Patent: May 26, 2026

(54) SHEET STORAGE DEVICE

(71) Applicant: Hinano Kouda, Tokyo (JP)

(72) Inventor: Toshiyuki Mae, Tokyo (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 18/747,538

(22) Filed: Jun. 19, 2024

(65) Prior Publication Data

US 2024/0425319 A1 Dec. 26, 2024

(30) Foreign Application Priority Data

Jun. 20, 2023 (JP) ..... 2023-100856

(51) Int. Cl.
*B65H 31/02* (2006.01)
*B65H 31/20* (2006.01)
*B65H 31/22* (2006.01)

(52) U.S. Cl.
CPC ..... *B65H 31/02* (2013.01); *B65H 31/20* (2013.01); *B65H 31/22* (2013.01); *B65H 2301/324* (2013.01); *B65H 2301/422548* (2013.01); *B65H 2402/42* (2013.01); *B65H 2405/312* (2013.01); *B65H 2601/211* (2013.01); *B65H 2601/252* (2013.01); *B65H 2701/1916* (2013.01); *B65H 2801/03* (2013.01)

(58) Field of Classification Search
CPC ..... B65H 31/02; B65H 31/20; B65H 31/22; B65H 2301/324; B65H 2301/422548; B65H 2402/42; B65H 2405/312; B65H 2601/211; B65H 2601/252; B65H 2701/1916; B65H 2801/03
See application file for complete search history.

(56) References Cited

U.S. PATENT DOCUMENTS 4,322,068 A * 3/1982 Cayn ..... G06K 13/12 271/198
6,968,763 B2 * 11/2005 Chapin ..... H05K 3/0097 83/164
2005/0133987 A1 * 6/2005 Asano ..... B65H 31/34 271/207
2010/0219579 A1 * 9/2010 Kato ..... B65H 31/02 271/207

(Continued)

FOREIGN PATENT DOCUMENTS

JP 9-020444 A 1/1997
JP 2000-185867 A 7/2000

*Primary Examiner* — Thomas A Morrison
(74) *Attorney, Agent, or Firm* — XSENSUS LLP

(57) ABSTRACT

A sheet storage device includes a sheet storage to stack and store sheets conveyed to the sheet storage in a conveyance direction. The sheet storage includes: a first sheet contact surface at a downstream end of the sheet storage in the conveyance direction; a second sheet contact surface at one end of the sheet storage in an orthogonal direction orthogonal to each of the conveyance direction and the gravity direction; a first inclined portion having an upper end at a downstream side and a lower end at an upstream side in the conveyance direction and having the first sheet contact surface tilted downward in a gravity direction from the upper end to the lower end; and a second inclined portion tilted downward in the gravity direction toward the second sheet contact surface in the orthogonal direction.

20 Claims, 10 Drawing Sheets

(56) References Cited

U.S. PATENT DOCUMENTS

| | | | | |
|---|---|---|---|---|
| 2014/0367395 | A1* | 12/2014 | Newhouse | B65H 1/027 220/660 |
| 2020/0216283 | A1* | 7/2020 | Lo | B65H 29/52 |

* cited by examiner

SHEET STORAGE DEVICE

CROSS-REFERENCE TO RELATED APPLICATION

This patent application is based on and claims priority pursuant to 35 U.S.C. § 119(a) to Japanese Patent Application No. 2023-100856, filed on Jun. 20, 2023, in the Japan Patent Office, the entire disclosure of which is hereby incorporated by reference herein.

BACKGROUND

Technical Field

The present disclosure relates to a sheet storage device.

Related Art

Sheet storage devices, such as those used to store sheets (e.g., envelopes ejected from the ejection section of an image forming apparatus), have been used.

Such sheet storage devices may cause disorganization and misalignment of stored sheets, resulting in improper storage within the devices.

SUMMARY

An embodiment of the present disclosure provides a sheet storage device includes a sheet storage to stack and store sheets conveyed to the sheet storage in a conveyance direction. The sheet storage includes: a first sheet contact surface at a downstream end of the sheet storage in the conveyance direction; a second sheet contact surface at one end of the sheet storage in an orthogonal direction orthogonal to each of the conveyance direction and the gravity direction; a first inclined portion having an upper end at a downstream side and a lower end at an upstream side in the conveyance direction and having the first sheet contact surface tilted downward in a gravity direction from the upper end to the lower end; and a second inclined portion tilted downward in the gravity direction toward the second sheet contact surface in the orthogonal direction.

BRIEF DESCRIPTION OF THE DRAWINGS

A more complete appreciation of embodiments of the present disclosure and many of the attendant advantages and features thereof can be readily obtained and understood from the following detailed description with reference to the accompanying drawings, wherein.

Figure 1:
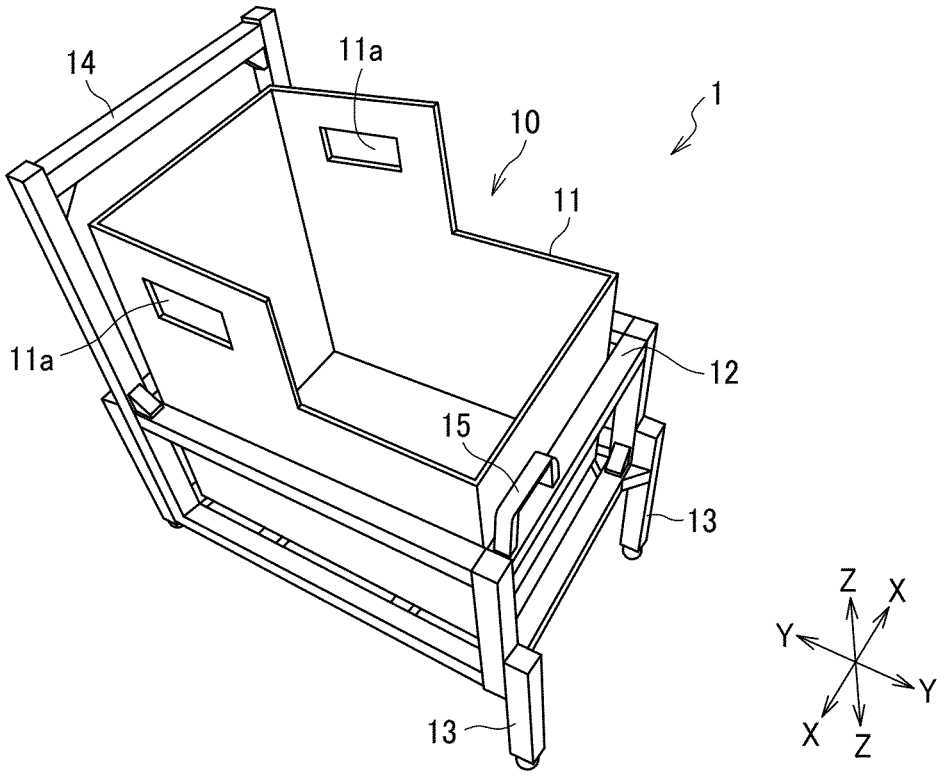
FIG. 1 is a perspective view of an envelope ejection tray according to an embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Referring now to the drawings, embodiments of the present disclosure are described below. As used herein, the singular forms "a," "an," and "the" are intended to include the plural forms as well, unless the context clearly indicates otherwise.

In a typical configuration of a sheet ejection tray in an image forming apparatus, the sheet ejection tray is spring-loaded and descends according to the weight of the sheet loaded on it. In this configuration, with a small number of sheets on the tray, the tray can receive ejected sheets at a high position, reducing the falling distance from the ejection position to the tray. This can prevent the sheets from being curled during their drop to the tray, ensuring proper storage on the tray.

In the configuration in which the sheet placement surface descends according to the weight of the sheets, additional mechanisms for this descending operation are needed, leading to higher device costs.

In view of the above circumstances, the sheets are to be stored with high positional accuracy.

According to one aspect of the present disclosure, the sheets are aligned and stored with high positional accuracy.

Referring to the drawings, embodiments of the present disclosure are described below. In the drawings, the same or corresponding parts are denoted by the same reference numerals, and redundant descriptions are simplified or omitted as appropriate. As an embodiment of a sheet storage device, an envelope ejection tray for stacking envelopes as sheets ejected from an image forming apparatus is described below.

As illustrated in FIG. 1, the envelope ejection tray 1 includes an envelope storage 10 as a sheet storage, and a support frame 12. The envelope storage 10 stores envelopes in a stacked manner. The envelope storage 10 includes a storage box 11 as a sheet storage member. The storage box 11 stores the envelopes stacked inside it. In FIG. 1, members placed inside the storage box 11 are omitted. The support frame 12 holds the storage box 11 around its outer sides and supports the storage box 11 from below. Thus, the storage box 11 is positioned within the support frame 12 and held to prevent it from falling off. The support frame 12 of the present embodiment is formed of an aluminum pipe. The support frame 12 has a handle 14 at one side of the envelope ejection tray 1 in the width direction. The handle 14 is a horizontally extending frame portion supported by an upwardly extending frame portion. The support frame 12 has another handle 15 on the opposite side in the width direction of the envelope ejection tray 1. The support frame 12 has leg portions 13. The leg portions 13 are placed at four corners of the envelope ejection tray 1 and include casters at the lower parts thereof. The envelope ejection tray 1 is made movable with the casters. The envelope ejection tray 1 can be moved by operating the handle 14 by the operator.

The directions X, Y, and Z in FIG. 1 are orthogonal to each other. The direction X is the front-to-back direction of the envelope ejection tray 1 and is also the main scanning direction in the image forming apparatus. The front side of the envelope ejection tray 1 is the near side of FIG. 1. The direction Y is the direction in which the envelope is conveyed (sheet conveyance direction) and the opposite direction. It is also the width direction (left-right direction) of the envelope ejection tray 1 and the sub-scanning direction in the image forming apparatus. The right side of FIG. 1 in the direction Y is adjacent to the image forming apparatus and is upstream of the envelope ejection tray 1 in the conveyance direction of the envelope. The direction Z is also the gravity direction and its opposite direction. The direction X is a direction orthogonal to both the conveyance direction of the envelope and the gravity direction. However, these directions X, Y, and Z do not need to be strictly orthogonal to each other. As will be described later, the conveyance direction of envelopes has a component in the direction Z, other than the direction parallel to the direction Y.

The direction Y is the conveyance direction of the envelope, which means that the main conveyance direction of the envelope is the direction Y.

The storage box 11 of the present embodiment is made of plastic, specifically a polypropylene corrugated box, and has an open top. The size of the open top, an opening, is set to 440 millimeters (mm)×320 mm.

The storage box 11 is a highly rigid product with a thickness of 5 mm and a basis weight of 1000 g/m$^2$. The storage box 11 has an internal height of 300 mm, allowing it to hold 500 square No. 2 envelopes. The storage box 11 is positioned so that the corrugations of the cardboard extend in the direction Z to prevent the envelopes from falling.

The storage box 11 is detachably attachable to the support frame 12. The storage box 11 has handle openings 11*a* at the upper portions of its front and back walls. The handle openings 11*a* allow the operator to grip the storage box 11 when it is removed from the support frame 12. The envelope ejection tray 1 can be carried by holding and lifting the handle 15.

The following describes an envelope stored in the envelope ejection tray 1 of the present embodiment.

Figure 2A:
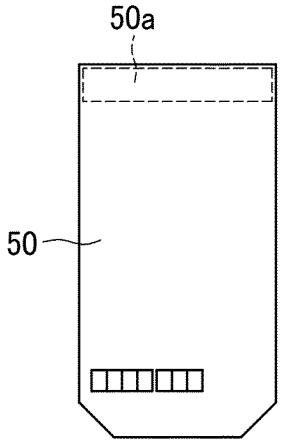
FIG. 2A is a plan view of an envelope.
Figure 2B:
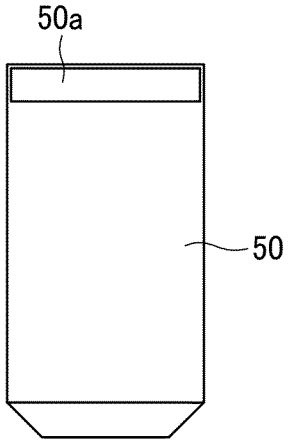
FIG. 2B is a bottom view of the envelope in FIG. 2A.
Figure 3:
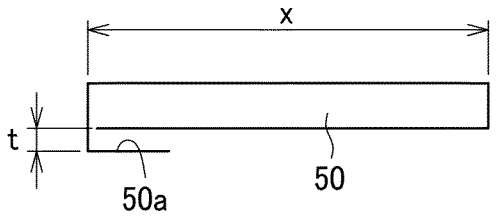
FIG. 3 is a side view of the envelope in FIGS. 2A and 2B.
Figure 4:
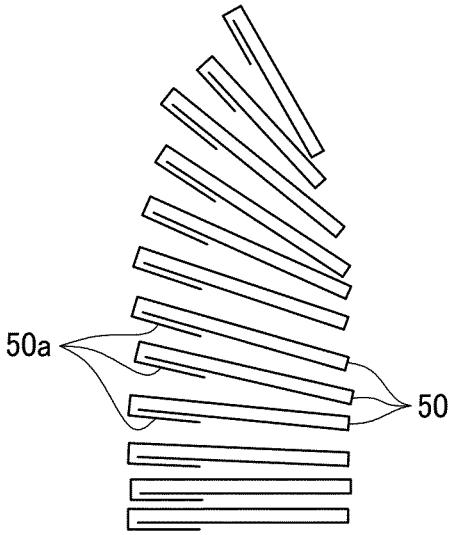
FIG. 4 is a side view of a stack of envelopes.

As illustrated in FIGS. 2A and 2B, the envelopes stacked on the envelope ejection tray of the present embodiment have an overlapping portion 50*a* that serves as a thick portion at one end (or the downstream end in the present embodiment) of the envelope in the conveyance direction, which is the longitudinal direction of the envelope. In other words, the overlapping portion 50*a* is located at one portion of the envelope 50 in the conveyance direction to form the envelope 50 into a bag shape. This configuration causes an increased thickness at the overlapping portion 50*a* of the envelope 50, leading to an uneven thickness of the envelope 50, as illustrated in FIG. 3. In other words, at the overlapping portion 50*a*, the paper forming the envelope is triple-layered and provided with adhesive, resulting in a thickness more than 1.5 times that of areas where only two layers overlap. Thus, as illustrated in FIG. 4, stacking multiple envelopes 50 horizontally leads to tilting and collapsing of the stack of the envelopes 50 toward the opposite side of the overlapping portion 50*a* due to the difference in thickness. To prevent air from being trapped inside the envelope 50 during the image formation in the image forming apparatus, the overlapping portion 50*a* is positioned on the downstream portion of the envelope 50 in the conveyance direction.

Figure 5:
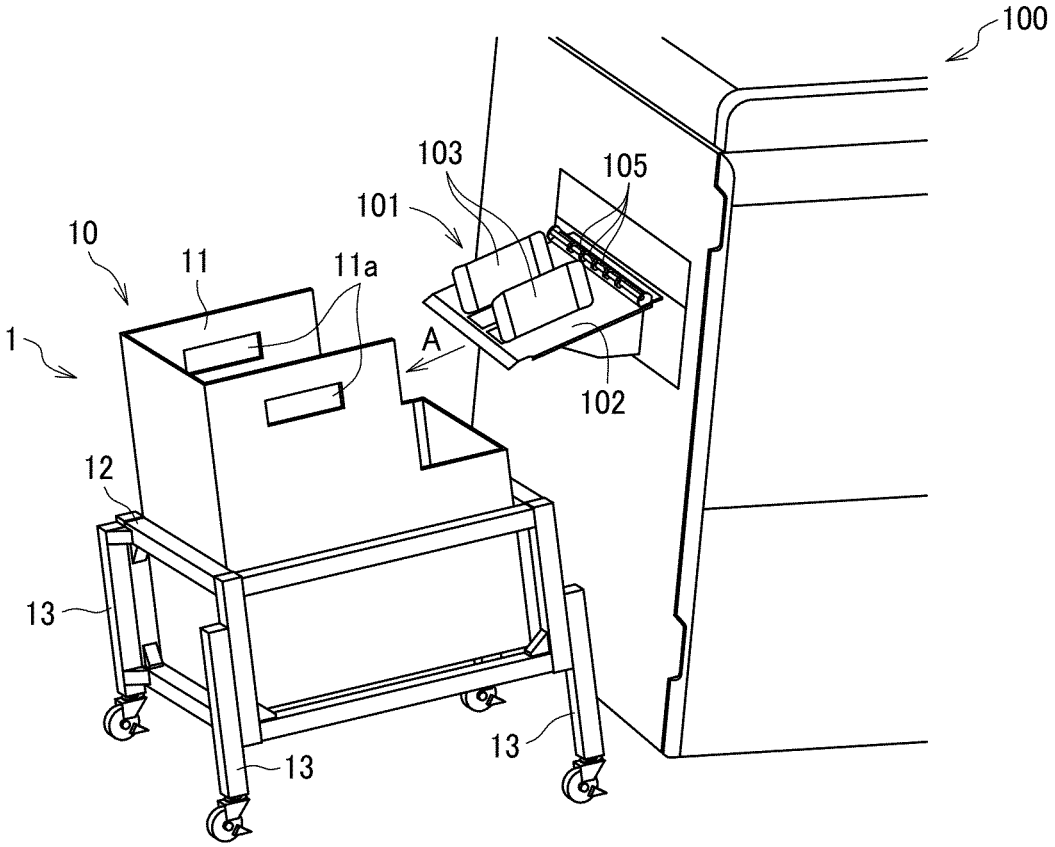
FIG. 5 is a perspective view of an ejection section and an envelope ejection tray of an image forming apparatus.
Figure 6:
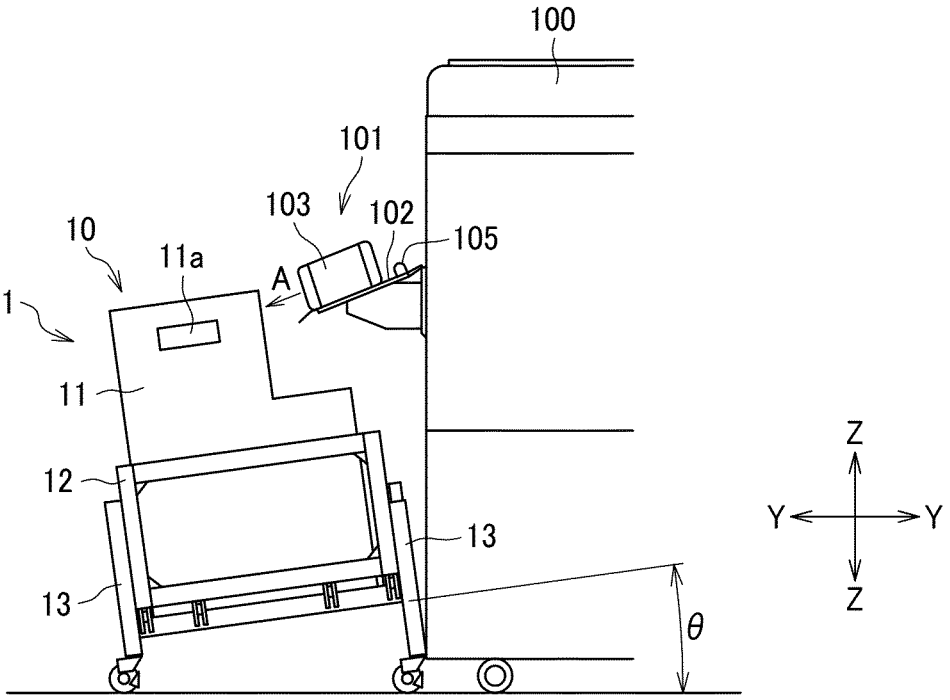
FIG. 6 is a front view of the ejection section and an envelope ejection tray of an image forming apparatus in FIG. 5.

How the envelopes are stored in the storage box 11 after being ejected from the image forming apparatus is described with reference to FIGS. 5 and 6. FIG. 5 is a perspective view of an ejection section of an image forming apparatus and an envelope ejection tray. FIG. 6 is a front view of the ejection section of the image forming apparatus and the envelope ejection tray in FIG. 5.

As illustrated in FIGS. 5 and 6, an envelope output from an image forming apparatus 100 to an ejection section 101 is conveyed in a direction of arrow A, and then ejected into the storage box 11 of the envelope ejection tray 1. The storage box 11 has an open top.

As illustrated in FIG. 6, the storage box 11 (or its placement surface) is tilted at an angle θ such that the downstream side in the direction Y is lower than the upstream side with respect to the upstream side with respect to the horizontal surface of the envelope ejection tray 1. The tilting angle θ of the storage box 11 is set to 15 to 20 degrees, and is set to 17 degrees in the present embodiment.

The envelope ejection tray 1 is positioned in the left-right direction with respect to the image forming apparatus 100 by bringing the casters into contact with the left side of the image forming apparatus 100 as illustrated in FIG. 6. Further, the storage box 11 is positioned in the front-to-back direction with respect to the image forming apparatus 100 by being brought into contact with the left side surface of the image forming apparatus 100 in FIG. 6. With the envelope ejection tray 1 positioned against the image forming apparatus 100, envelopes are ejected from the image forming apparatus 100 onto the envelope ejection tray 1. FIG. 5 illustrates the envelope ejection tray 1 before it is positioned against the image forming apparatus 100.

Figure 7:
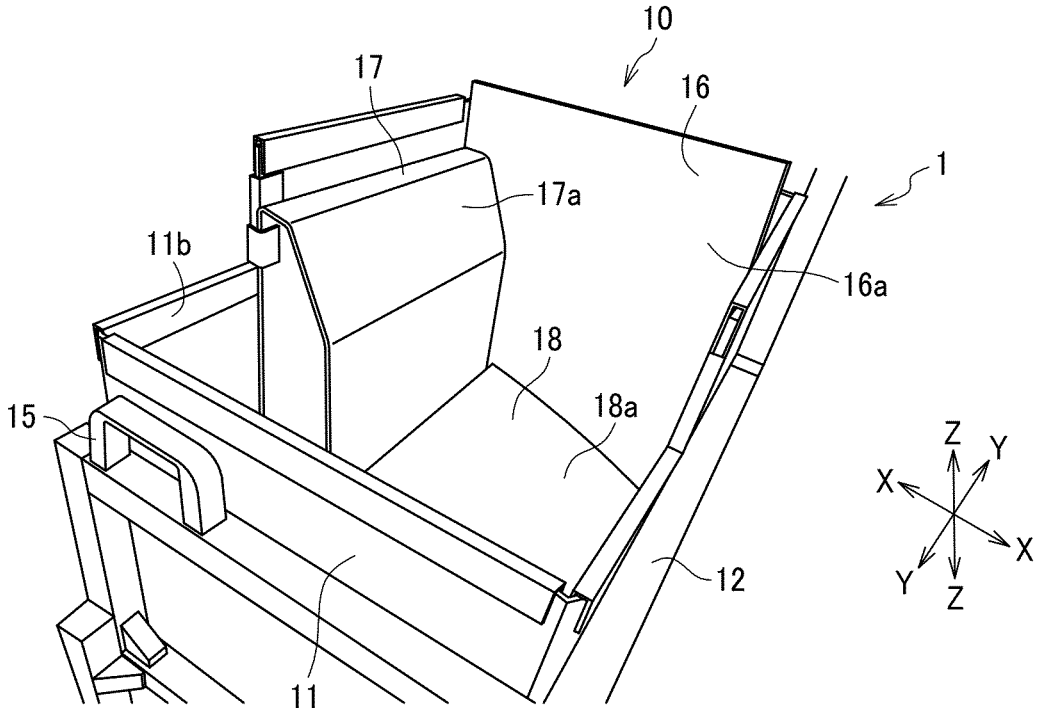
FIG. 7 is a perspective view of a more detailed configuration of an envelope storage section.

FIG. 7 is a perspective view illustrating a detailed configuration of the envelope storage 10.

As illustrated in FIG. 7, the storage box 11 includes reinforcements 11*b* at its opening end. In the present embodiment, the reinforcements are particularly formed around the entire perimeter of the opening. The reinforcements 11*b* of the present embodiment are formed by fixing resin members to the opening end of the storage box 11 with, for example, an adhesive. By providing the reinforcements 11*b*, the strength of the opening end of the storage box 11 is increased, and the deformation of the storage box 11 is prevented.

The envelope storage 10 includes an envelope contact plate 16 as a sheet contact member, a guide 17 as an inclined member, and an envelope support member 18 as a sheet placement member, all inside the storage box 11. The envelope contact plate 16 is placed at the downstream end of the storage box 11 in the conveyance direction of the envelope. The envelope contact plate 16 has a first envelope contact surface 16*a*. For example, in the present embodiment, the envelope contact plate 16 is positioned in the storage box 11 so that the first envelope contact surface 16*a* is parallel to the downstream side of the storage box 11 in the conveyance direction. The first envelope contact surface 16*a* contacts the leading end (or the downstream end) of an envelope in the conveyance direction, ejected from the image forming apparatus onto the storage box 11. The guide 17 is placed on the front side inside the storage box 11. The envelope support member 18 is placed on the rear side relative to the guide 17 inside the storage box 11 and is positioned at the bottom.

Figure 8:
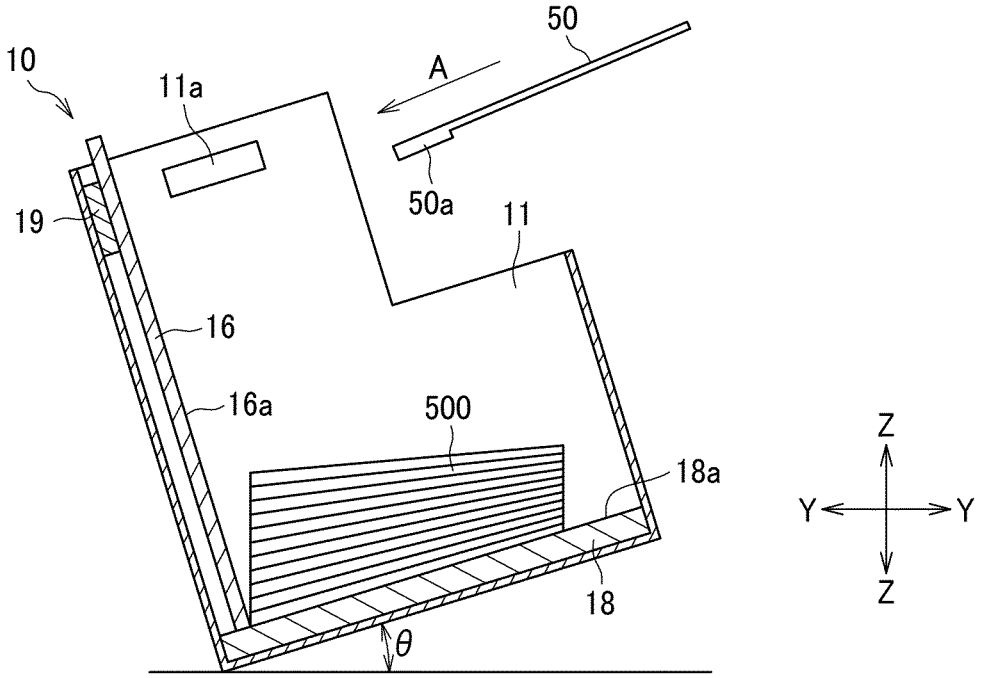
FIG. 8 is a cross-sectional view of the inclination in a conveyance direction within a storage box.

FIG. 8 is a cross-sectional view of the inclination in the conveyance direction within the storage box.

As illustrated in FIG. 8, an envelope 50 enters the storage box 11 in the direction of the arrow A after being ejected from the image forming apparatus. The envelope 50 first comes into contact with the first envelope contact surface 16*a* of the envelope contact plate 16 and then falls onto the envelope placement surface 18*a*, which is the upper surface of the envelope support member 18.

An envelope placement surface 18*a*, or the sheet placement surface, which is the upper surface of the storage box 11, is positioned lower than the ejection section 101 (see FIG. 6). Due to the inclination of the storage box 11 with respect to the horizontal plane, the first envelope contact surface 16*a* is inclined downward in the gravity direction, from the downstream side to the upstream side (sloping downward from left to right in FIG. 8). In other words, the first inclined portion is formed on the first envelope contact surface 16*a*.

Since the first envelope contact surface 16*a* has the first inclined portion, the space in the conveyance direction within the storage box 11 where the envelope 50 can be stored is narrowed toward the upstream side of the storage box 11 in the conveyance direction as it goes downward in the gravity direction. As a result, even if there is some variation in the posture of the envelopes 50 when it falls due to differences in the amount of pushback toward the upstream side in the conveyance direction caused by the collision of the envelope 50 with the envelope contact surface 16*a*, the variation in the position of the leading end of the envelope 50 in the conveyance direction when they are finally stored in the storage box 11 can be minimized. This ensures that the envelopes 50 placed on the envelope placement surface 18*a* can be aligned against the envelope contact surface 16*a*. As an example of the behavior of the envelope 50 until the envelope 50 is stored in the storage box 11, the leading end of the envelope 50 is pushed back to the upstream side in the conveyance direction by the impact of the first collision with the envelope contact surface 16*a*. Then, the envelope 50 falls and the leading end thereof is again brought into contact with the envelope contact surface 16*a*, and falls along the envelope contact surface 16*a*. The envelope 50 is placed on the envelope placement surface 18*a* with its leading end aligned along the envelope contact surface 16*a*.

Due to the inclination of the storage box 11 with respect to the horizontal plane, the envelope placement surface 18*a* is inclined downward in the gravity direction, so that the downstream side of the envelope placement surface 18*a* in the conveyance direction is lower than the upstream side. The overlapping portion 50*a* of the envelope 50 to be stored in the storage box 11 is positioned at the downstream end of the envelope 50 in the conveyance direction. As a result, the thicker side of an envelope bundle 500, where the overlapping portion 50*a* is present, can be prevented from bulging and tilting toward the overlapping portion 50*a*. Thus, more envelopes 50 can be stacked and stored in the storage box 11 without collapsing the envelope bundle 500. If the inclination of the envelope placement surface 18*a* is steep, the envelopes 50 placed on the envelope placement surface 18*a* can be guided toward the envelope contact surface 16*a*.

The storage box 11 includes a shock absorber 19 between the envelope contact plate 16 and the downstream-end surface of the storage box 11 in the conveyance direction of envelopes. The shock absorber 19 is placed on the back surface of the envelope contact plate 16, on the areas where the envelope does not come into contact. The shock absorber 19 is formed of, for example, sponge. The shock absorber 19 mitigates the impact caused by the envelope 50 colliding with the envelope contact plate 16 and reduces the wear of the envelope contact plate 16. The shock absorber 19 further reduces the distance by which the envelope 50 is pushed back upon colliding with the envelope contact surface 16*a*, and minimizes the variation in the distance.

The inclination of the storage box 11 in the front-to-back direction is described with reference to FIG. 9.

Figure 9:
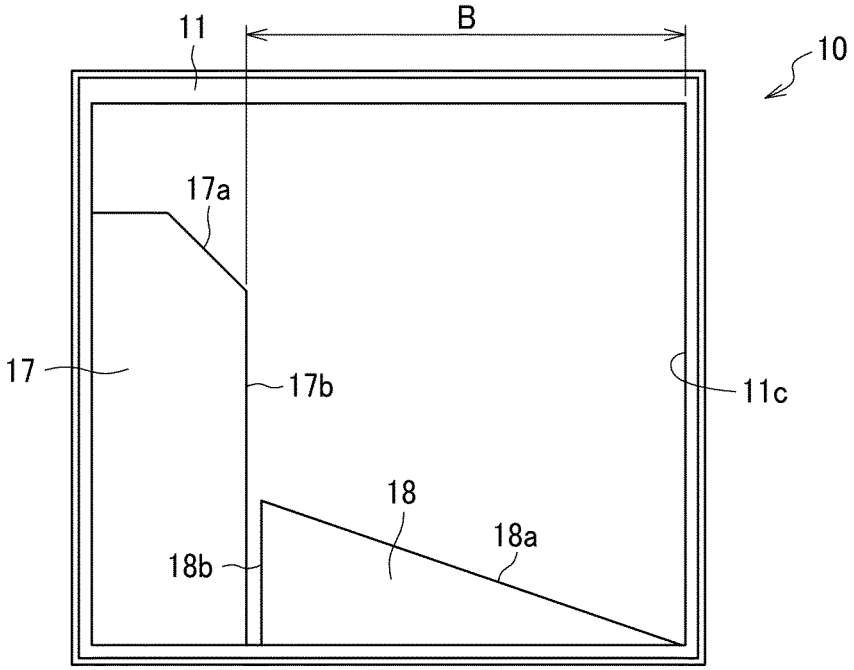
FIG. 9 is a cross-sectional view of the inclination in a direction orthogonal to a conveyance direction within a storage box.

As illustrated in FIG. 9, the guide 17 placed at the front of the storage box 11 has a trapezoidal shape with an inclined surface 17*a* on its upper side. The guide 17 placed within the storage box 11 restricts and reduces the storage width B for storing the envelopes within the storage box 11. In the present embodiment, the storage width B is set to be 245 mm.

The envelope support member 18 is placed on the bottom surface of the storage box 11. The envelope placement surface 18*a*, which is the upper surface of the envelope support member 18, is a surface on which the envelopes 50 are placed and stacked within the envelope storage 10. The envelope support member 18 has a vertical surface 18*b* adjacent to the guide 17 and facing a vertical surface 17*b* of the guide 17.

The inclined surface 17*a* and the envelope placement surface 18*a* are inclined downward in the gravity direction from the front side to the rear side (from the left to the right in FIG. 9) of the storage box 11. In other words, the inclined surface 17*a* and the envelope placement surface 18*a* form a second inclined portion of the present embodiment that is inclined downward in the gravity direction toward the rear side 11*c* (or a second sheet contact surface) of the storage box 11.

How the envelopes 50 are stored in the storage box 11 is described with reference to FIGS. 10 to 12, 13, and 14.

Figure 10:
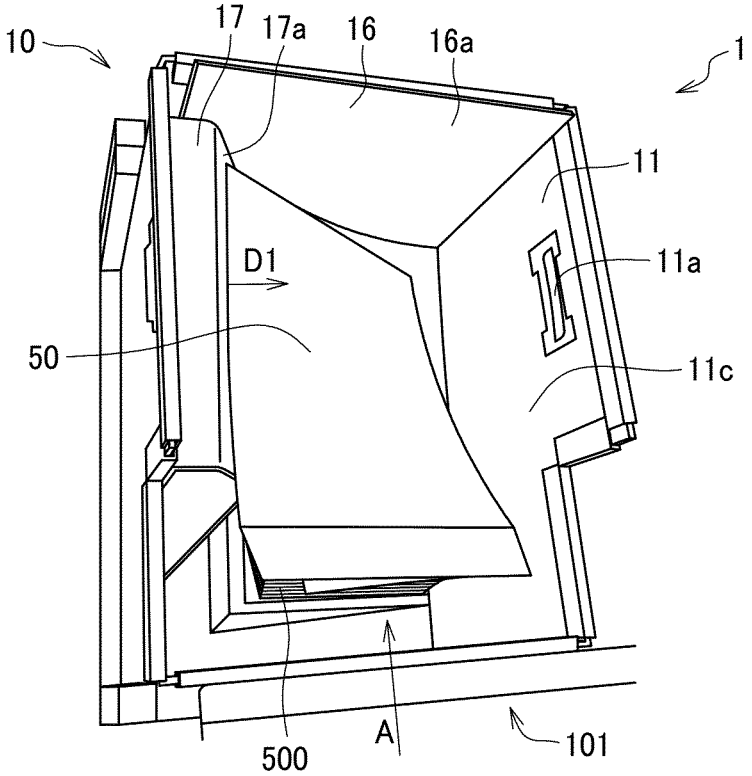
FIG. 10 is a perspective view of envelopes stored in a storage box.
Figure 11:
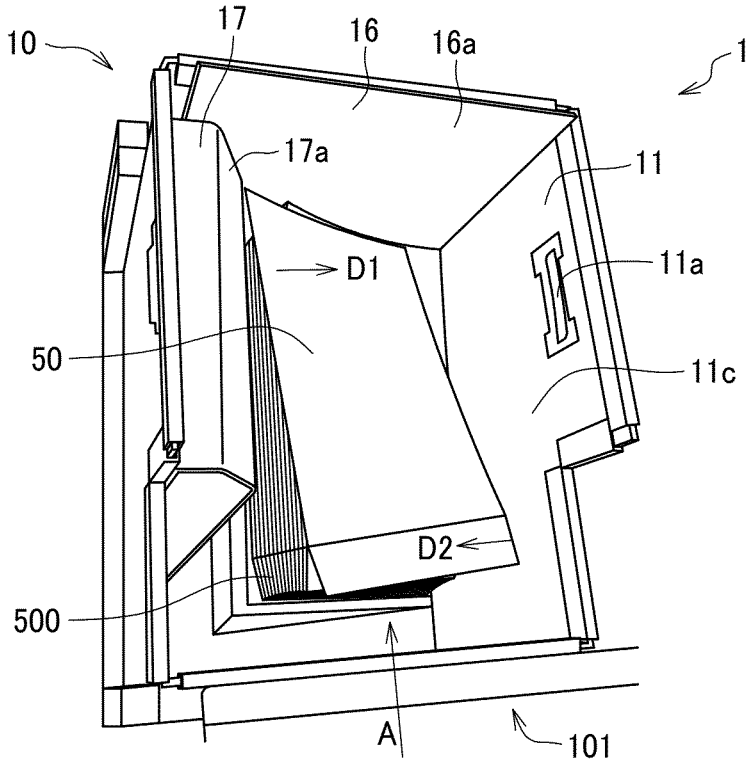
FIG. 11 is a perspective view of envelopes stored in a storage box.
Figure 12:
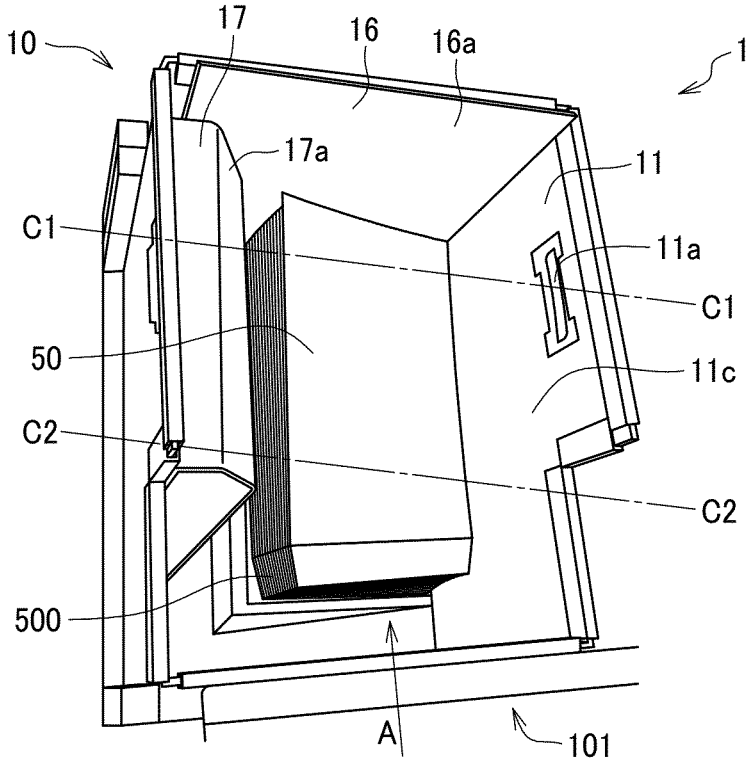
FIG. 12 is a perspective view of envelopes stored in a storage box.

As illustrated in FIG. 10, the leading end of the envelope 50 comes into contact with the envelope contact surface 16*a* after being ejected from the ejection section 101 into the storage box 11 in the direction of the arrow A. The portion of the envelope 50 at one end in the width direction, mainly the downstream end in the conveyance direction (the upper left portion in FIG. 10) is guided along the inclined surface 17*a* and falls toward the bottom surface of the storage box 11. As a result, the envelope 50 moves to the right in FIG. 10 (see arrow D1 in FIG. 10). As illustrated in FIG. 11, the upstream portion in the conveyance direction on the other end in the width direction (the lower right portion in FIG. 11) first collides with the rear side 11*c* of the storage box 11. Then, as illustrated in FIG. 12, the envelopes 50 are stored in the storage box 11 along the rear side 11*c*. The width direction of the envelope of the present embodiment is a direction orthogonal to the conveyance direction and the thickness direction of the envelope.

Figure 13:
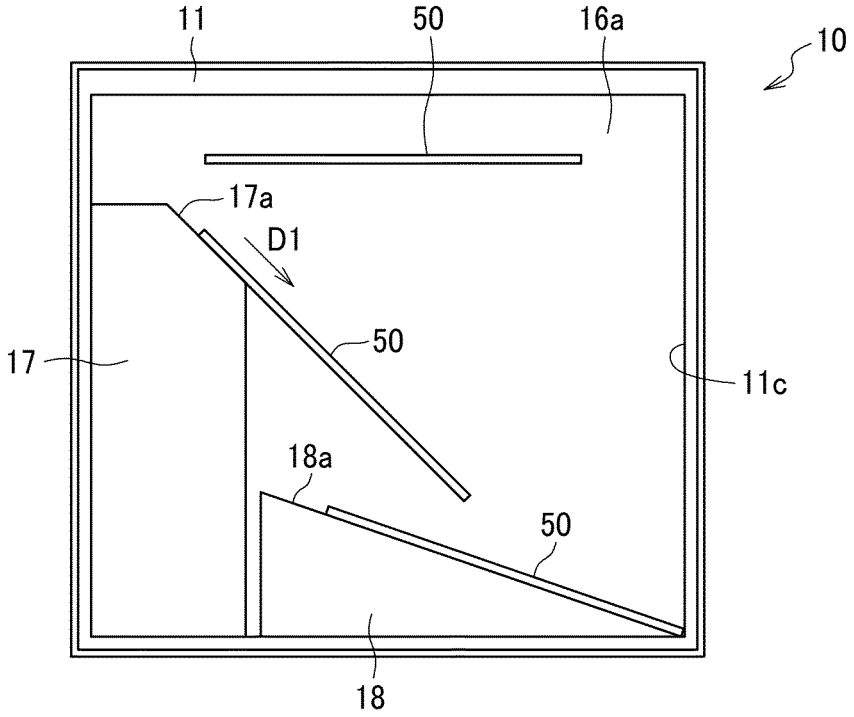
FIG. 13 is a C1-C1 cross-sectional view of the storage box in FIG. 12, illustrating the behavior downstream in a conveyance direction of the envelopes in FIGS. 10 to 12.

FIG. 13 is a C1-C1 cross-sectional view of the storage box in FIG. 12, illustrating the behavior downstream in a conveyance direction of the envelopes 50 in FIGS. 10 to 12; For convenience, FIG. 13 illustrates a state in which the envelope 50 is not deformed, but the envelope 50 is actually deformed as illustrated in FIGS. 10 to 12.

As illustrated in FIG. 13, the envelope 50 colliding with the envelope contact surface 16*a* falls while being guided to the right of FIG. 13 along the inclined surface 17*a* (see the arrow D1 in FIG. 13). Then, the envelope 50 comes into contact with the rear side 11*c* and falls onto the envelope placement surface 18*a*. Alternatively, the envelope 50 is first placed on the envelope placement surface 18*a*, and then guided along the inclined envelope placement surface 18*a* to contact the rear side 11*c*. In this way, the inclined surface 17*a* guides the envelope 50 to the rear side 11*c* at a position higher than the envelope placement surface 18*a*. Thus, the envelope 50 can be moved toward the rear side 11*c* by utilizing the falling distance, allowing the side edge of the envelope 50 to be aligned with the rear side 11*c* and placed on the envelope placement surface 18*a*.

Figure 14:
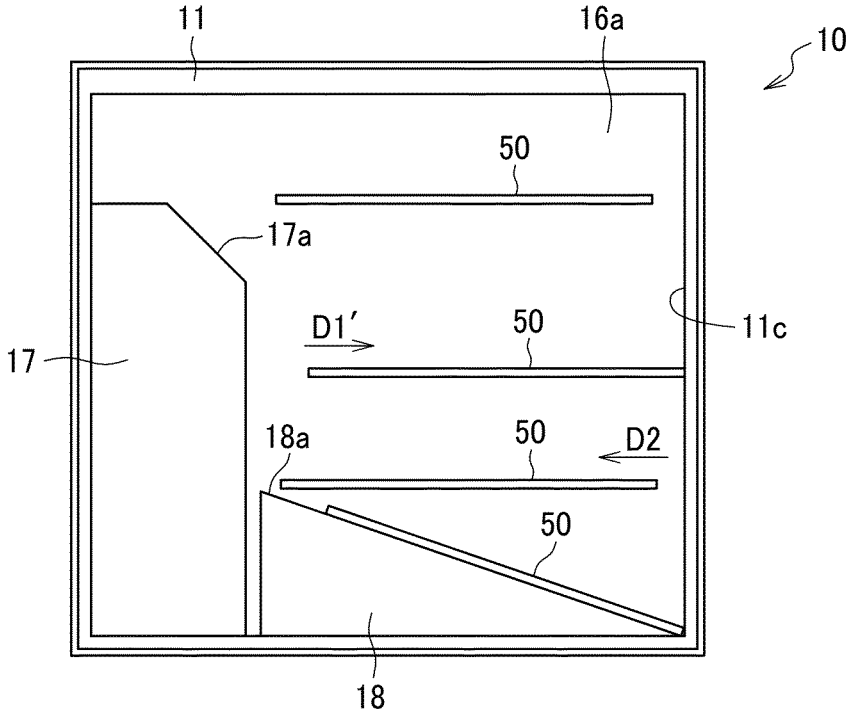
FIG. 14 is a C2-C2 cross-sectional view of the storage box in FIG. 12, illustrating the behavior upstream in a conveyance direction of the envelopes in FIGS. 10 to 12.

FIG. 14 is a C2-C2 cross-sectional view of the storage box in FIG. 12, illustrating the behavior upstream in a conveyance direction of the envelopes 50 in FIGS. 10 to 12. For convenience, FIG. 14 illustrates a state in which the envelope 50 is not deformed, but the envelope 50 is actually deformed as illustrated in FIGS. 10 to 12.

As illustrated in FIG. 14, when the envelope 50 collides with the envelope contact surface 16*a*, the downstream portion of the envelope 50 in the conveyance direction is guided by the inclined surface 17*a* (see FIG. 13), causing the upstream portion of the envelope 50 in the conveyance direction to also be urged in the direction of arrow D1'. As a result, the other end of the envelope 50 in the width direction collides with the rear side 11*c* and receives a repulsive force in the direction of the arrow D2. Then, the upstream portion of the envelope 50 in the conveyance direction is temporarily returned to the left in FIG. 14. The envelope 50 is placed on the envelope placement surface 18*a*, and then guided along the inclined envelope placement surface 18*a* to contact the rear side 11*c*.

As described above, the upstream portion of the envelope 50 in the conveyance direction swings like a pendulum to the left and right in FIG. 14 while falling in the storage box 11, and is finally stored in alignment with the rear side 11*c*.

As described above, in the present embodiment, the first inclined portion allows the envelopes 50 to be aligned and stored in the downstream portion of the storage box 11 in the conveyance direction. Further, the second inclined portion allows the envelopes 50 to be aligned and stored adjacent to the rear side 11*c* of the storage box 11. As described above, by inclining the surfaces in both the conveyance direction and the direction orthogonal to the conveyance direction, the envelopes 50 can be precisely aligned with the surfaces inside the storage box 11. Thus, the envelopes can be precisely aligned and stored within the storage box 11. Even when a large number of envelopes 50 are stacked and stored in the storage box 11, the position and orientation of each envelope in the stack can be maintained. Without adding additional movable parts such as springs or drive mechanisms to the storage box 11, the envelopes 50 can be accurately positioned and stored within the storage box 11, resulting in a cost-effective and highly safe envelope ejection tray.

As described above, by inclining the envelope placement surface 18*a* downward in the gravity direction toward the downstream side in the conveyance direction, as illustrated in FIG. 8, the bulging of the envelope bundle 500 can be reduced, allowing more envelopes 50 to be stored in the storage box 11 even if the downstream portion of the envelopes 50 is thicker.

Further, the second inclined portion allows the envelopes 50 to be aligned and stored in the direction orthogonal to the conveyance direction. Even if one side of the envelopes 50 is thicker in the orthogonal direction orthogonal to the conveyance direction, the bulging of the envelope bundle 500 can be reduced, enabling more envelopes 50 to be stored in the storage box 11 (details will be described later).

Further, the guide 17 restricts the swinging range of the envelope 50 in the horizontal direction in FIG. 14, so that the falling behavior of the envelope 50 is stabilized, and the envelope 50 can be placed on the envelope placement surface 18*a* with high positional accuracy. In the present embodiment, the swing range is set to 245 mm for a No. 2 square envelope with a width of 240 mm.

Figure 15:
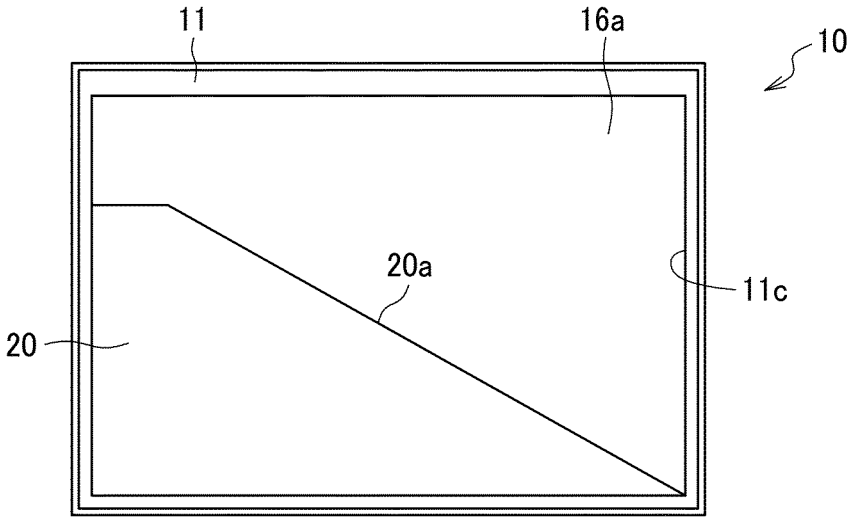
FIG. 15 is a cross-sectional view of an envelope ejection tray according to a modification of an embodiment of the present disclosure.

Particularly in the present embodiment, the inclined surface 17*a* guides the envelopes 50 toward the rear side 11*c*. Additionally, the inclined envelope placement surface 18*a* guides and aligns the envelopes 50 placed on it toward the rear side 11*c*. However, as illustrated in FIG. 15, the second inclined portion may be formed only by an envelope placement surface 20*a* of an envelope support member 20. The second inclined portion formed by the envelope placement surface 20*a* allows the envelopes 50 to be placed on the envelope placement surface so as to be aligned with the rear side 11*c*. Further, as in the above-described embodiment, inclining the storage box 11 in the conveyance direction forms a first inclined portion on the envelope placement surface 20*a*. The configuration of FIG. 15 is suitable for a case where the number of envelopes allowed to be stacked in the storage box 11 is small, for example. In FIG. 9, the guide 17 and the envelope support member 18 may be formed as an integral single unit.

Figure 16A:
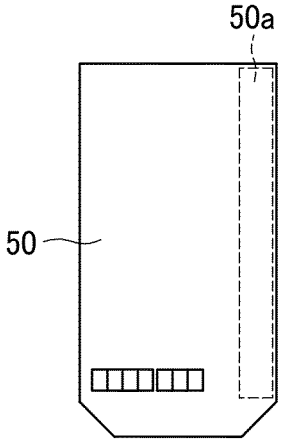
FIG. 16A is a plan view of an envelope in a form different from that of FIG. 2A.
Figure 16B:
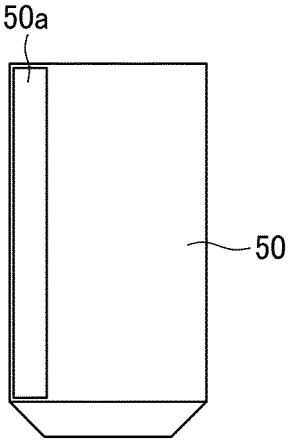
FIG. 16B is a bottom view of the envelope in FIG. 16A.

Further, although the case where the envelope 50 has the overlapping portion 50*a* on one end portion in the conveyance direction (see FIG. 10) is described above, the envelope 50 may have an overlapping portion 50*a* on one end in its width direction as illustrated in FIGS. 16A and 16B.

Figure 17:
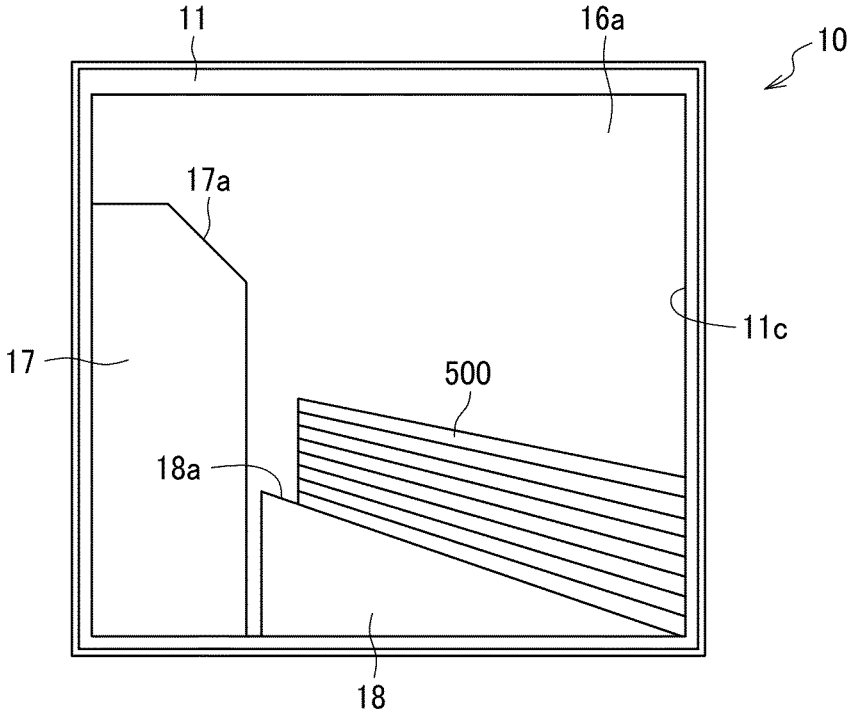
FIG. 17 is a cross-sectional view of a storage box in which the envelops of FIGS. 16A and 16B are stacked.

In this case, as illustrated in FIG. 17, the overlapping portions 50*a* of the envelopes 50 are placed at the lower side of the envelope placement surface 18*a* of the envelope support member 18. This prevents the overlapping portions 50*a* of the envelope bundle 500 from bulging and inclining.

A configuration of an ejection section included in an image forming apparatus is described below. The image forming apparatus prints an image on an envelope and then ejects the envelope from the ejection section toward the envelope ejection tray.

Figure 18:
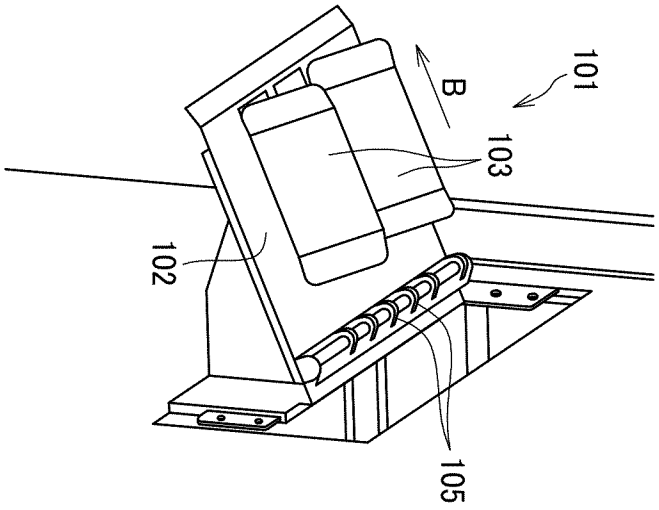
FIG. 18 is a perspective view of an ejection section of an image forming apparatus.

As illustrated in FIG. 18, the ejection section 101 includes a chute 102, a pair of side fences 103, and ball bearing rollers 105. The chute 102 is formed of, for example, a metal plate. The chute 102 is tilted downward in the gravity direction. In other words, the chute 102 is tilted in the direction of arrow B. The chute 102 is secured to the body of the image forming apparatus by screwing, using, for example, a screw hole for connecting a peripheral device included in the image forming apparatus. The envelope ejected from the image forming apparatus falls on the chute 102 toward the envelope ejection tray while having its side end position regulated by the side fences 103. The ball bearing rollers 105 without lubricant are disposed on the chute 102. By providing the ball bearing rollers 105, an envelope 50 can smoothly fall along the chute 102.

Figure 19:
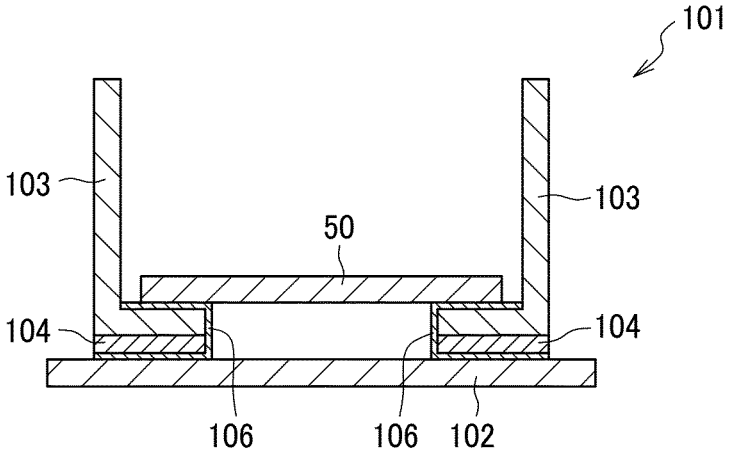
FIG. 19 is a cross-sectional view of the ejection section of FIG. 18.

As illustrated in FIG. 19, a magnet sheet 104 is attached to the lower surface of the side fence 103. The magnet sheet 104 is attached to the side fence 103 by, for example, a double-sided tape. The side fence 103 can be attached to any desired position on the chute 102 by the magnetic force of the magnet sheet 104. Thus, the side fences 103 can change the regulated position that restricts the widthwise position of the envelopes, allowing for adjustment to match the width of the envelope 50. A fluorine tape 106 is wound around the portions of the side fence 103 and the magnet sheet 104, adjacent to where the envelope 50 passes. This prevents the envelope 50 from being caught by the edge of the side fence 103, and allows the envelope 50 to smoothly fall on the side fence 103.

This disclosure has been described above with reference to specific embodiments. It is to be noted that this disclosure is not limited to the details of the embodiments described above, but various modifications and enhancements are possible without departing from the scope of the invention. It is therefore to be understood that this disclosure may be practiced otherwise than as specifically described herein. For example, elements and/or features of different embodiments may be combined with each other and/or substituted for each other within the scope of this invention. The number of constituent elements and their locations, shapes, and so forth are not limited to any of the structure for performing the methodology illustrated in the drawings.

In the above description, the envelope is exemplified as an example of the sheet, but the sheet stored in the sheet storage device of the present disclosure is not limited thereto. The "sheet" includes the sheet P (plain papers), thick papers, postcards, thin papers, coated papers (coated papers, art papers, etc.), tracing papers, OHP sheets, plastic films, prepreg, and copper foil, in addition to envelopes. The sheet is not necessarily limited to a sheet having a thick portion.

In the above description, the sheet storage device for stacking and storing the sheets ejected from the image forming apparatus has been exemplified, but the present disclosure is not limited thereto.

In the above embodiment, with the storage box 11 inclined in the conveyance direction of the envelope, the first envelope contact surface 16*a* forms a first inclined portion (see FIG. 5). However, in some examples, the inclination of the first envelope contact surface 16*a* relative to the storage box 11 may form a first inclined portion. The inclination of the storage box 11 in a direction orthogonal to the conveyance direction may form a second inclined portion. The envelope contact plate 16, the guide 17, and the envelope support member 18 placed in the storage box 11 may be fixed to the storage box 11.

Aspects of the present invention are as follows.

Aspect 1

A sheet storage device includes a sheet storage to stack and store sheets conveyed to the sheet storage in a conveyance direction. The sheet storage includes: a first sheet contact surface at a downstream end of the sheet storage in the conveyance direction; a second sheet contact surface at one end of the sheet storage in an orthogonal direction orthogonal to each of the conveyance direction and the gravity direction; a first inclined portion having an upper end at a downstream side and a lower end at an upstream side in the conveyance direction and having the first sheet contact surface tilted downward in a gravity direction from the upper end to the lower end; and a second inclined portion tilted downward in the gravity direction toward the second sheet contact surface in the orthogonal direction.

Aspect 2

In the sheet storage device according to Aspect 1, the sheet storage further incudes a sheet placement surface at a bottom of the sheet storage, to stack the sheets. The second inclined portion is at another end of the sheet storage opposite to the second sheet contact surface in the orthogonal direction; and at a position higher than the sheet placement surface in the gravity direction.

Aspect 3

In the sheet storage device according to Aspect 2, the sheet storage further includes: a storage box having an opening top to which the sheets are ejected, the storage box having the first sheet contact surface, the second sheet contact surface, the first inclined portion, and the second inclined portion; and a support frame to which the storage box is detachably attached.

Aspect 4

In the sheet storage device according to any one of Aspects 1 to 3, the sheet storage further includes a storage box having an opening top to which the sheets are ejected; and a support frame to which the storage box is detachably attached.

Aspect 5

In the sheet storage device according to any one of Aspects 1 to 4, the sheet storage further includes a storage box having an opening to which the sheets are ejected; a support frame to which the storage box is detachably attached; and a sheet placement member having a sheet placement surface to stack the sheets, the sheet placement surface including the second inclined portion.

Aspect 6

In the sheet storage device according to any one of Aspects 1 to 5, the sheet storage further includes a storage box. The storage box is tilted downward in the gravity direction and toward the downstream end of the sheet storage in the conveyance direction to form the first inclined portion by the first sheet contact surface.

Aspect 7

In the sheet storage device according to any one of Aspects 1 to 6, the sheet storage further includes a storage box to store the sheets; a sheet contact member having the first sheet contact surface; and a shock absorber between the sheet contact member and the storage box.

Aspect 8

In the sheet storage device according to any one of Aspects 1 to 7 the sheet storage further includes a sheet placement surface tilted downward in the gravity direction with an upstream end higher than a downstream end of the sheet placement surface in the conveyance direction, to stack the sheets.

Aspect 9

In the sheet storage device according to Aspect 8, the sheet storage further includes a storage box to store the sheets, each having a thick portion at one end facing the first sheet contact surface; and a thin portion at another end and farther from the first sheet contact surface than the thick portion, in the conveyance direction. The thick portion is thicker than the thin portion.

Aspect 10

In the sheet storage device according to any one of Aspects 1 to 7, the sheet storage further includes a storage box to store the sheets, each having a thick portion at one end facing the second sheet contact surface; and a thin portion at another end and farther from the second sheet contact surface than the thick portion, in the orthogonal direction. The thick portion is thicker than the thin portion.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

The invention claimed is:

1. A sheet storage device comprising:

a sheet storage to stack and store sheets conveyed to the sheet storage in a conveyance direction, the sheet storage including:

a first sheet contact surface at a downstream end of the sheet storage in the conveyance direction;

a second sheet contact surface at one end of the sheet storage in an orthogonal direction orthogonal to each of the conveyance direction and a gravity direction;

a first inclined portion having an upper end at a downstream side and a lower end at an upstream side in the conveyance direction and having the first sheet contact surface tilted downward in the gravity direction from the upper end to the lower end; and a second inclined portion tilted downward in the gravity direction toward the second sheet contact surface in the orthogonal direction, wherein:

the first inclined portion and the second inclined portion cause the sheets to naturally align with the conveyance direction and the gravity direction; and the first inclined portion and the second inclined portion cause the sheets to collide with the first inclined portion and the second inclined portion, be pushed back, and be brought into contact again with the first inclined portion and the second inclined portion to be aligned.

2. The sheet storage device according to claim 1, wherein:

the sheet storage further includes a sheet placement surface at a bottom of the sheet storage, to stack the sheets, and the second inclined portion is:

at another end of the sheet storage opposite to the second sheet contact surface in the orthogonal direction; and at a position higher than the sheet placement surface in the gravity direction.

3. The sheet storage device according to claim 2, wherein the sheet storage further includes:

a storage box having an opening top to which the sheets are ejected, the storage box having the first sheet contact surface, the second sheet contact surface, the first inclined portion, and the second inclined portion; and a support frame to which the storage box is detachably attached.

4. The sheet storage device according to claim 1, wherein the sheet storage further includes:

a storage box having an opening top to which the sheets are ejected; and a support frame to which the storage box is detachably attached.

5. The sheet storage device according to claim 1, wherein the sheet storage further includes:

a storage box having an opening to which the sheets are ejected;

a support frame to which the storage box is detachably attached; and a sheet placement member having a sheet placement surface to stack the sheets, the sheet placement surface including the second inclined portion.

6. The sheet storage device according to claim 1, wherein:

the sheet storage further includes a storage box, and the storage box is tilted downward in the gravity direction and toward the downstream end of the sheet storage in the conveyance direction to form the first inclined portion by the first sheet contact surface.

7. The sheet storage device according to claim 1, wherein the sheet storage further includes:

a storage box to store the sheets;

a sheet contact member having the first sheet contact surface; and a shock absorber between the sheet contact member and the storage box.

8. The sheet storage device according to claim 1, wherein;

the sheet storage further includes a sheet placement surface tilted downward in the gravity direction with an upstream end higher than a downstream end of the sheet placement surface in the conveyance direction, to stack the sheets.

9. The sheet storage device according to claim 8, wherein;

the sheet storage further includes a storage box to store the sheets, each having:

a thick portion at one end facing the first sheet contact surface; and a thin portion at another end and farther from the first sheet contact surface than the thick portion, in the conveyance direction, and the thick portion is thicker than the thin portion.

10. The sheet storage device according to claim 1, wherein:

the sheet storage further includes a storage box to store the sheets, each having:

a thick portion at one end facing the second sheet contact surface; and a thin portion at another end and farther from the second sheet contact surface than the thick portion, in the orthogonal direction, and the thick portion is thicker than the thin portion.

11. The sheet storage device according to claim 3, wherein;

the storage box is made of plastic.

12. The sheet storage device according to claim 3, wherein:

the support frame comprises a plurality of legs, and at least one of the plurality of legs includes a caster.

13. The sheet storage device according to claim 3, wherein:

the support frame further comprises a handle.

14. The sheet storage device according to claim 3, wherein:

the storage box comprises at least one handle opening.

15. The sheet storage device according to claim 3, wherein:

the storage box comprises a reinforcement at the opening top.

16. The sheet storage device according to claim 6, wherein:

an angle of tilt of the storage box is between 15 degrees and 20 degrees relative to a horizontal surface.

17. The sheet storage device according to claim 7, wherein:

the shock absorber comprises sponge.

18. The sheet storage device according to claim 1, further comprising:

a guide disposed within the sheet storage, wherein the second inclined portion is on the guide.

19. The sheet storage device according to claim 2, wherein:

the sheet placement surface includes the second inclined portion.

20. The sheet storage device according to claim 3, wherein:

the storage box includes a polypropylene corrugated material.

* * * * *